United States Patent [19]

Bausch et al.

[11] Patent Number: 4,908,140

[45] Date of Patent: Mar. 13, 1990

[54] METHOD OF ENHANCING FABRIC REWETTABILITY WITH AN AQUEOUS EMULSION OF BRANCHED AND CROSS-LINKED POLYDIMETHYLSILOXANE

[75] Inventors: Gregory G. Bausch; Elizabeth A. Seelbach; Alan Zombeck, all of Midland, Mich.

[73] Assignee: Dow Corning Corporation, Midland, Mich.

[21] Appl. No.: 312,158

[22] Filed: Feb. 21, 1989

Related U.S. Application Data

[63] Continuation-in-part of Ser. No. 236,864, Oct. 26, 1988, abandoned.

[51] Int. Cl.[4] ..... D06M 00/00

[52] U.S. Cl. ..... 252/8.6; 8/137; 252/8.8

[58] Field of Search ..... 252/8.6, 8.8

[56] References Cited

U.S. PATENT DOCUMENTS 2,891,920 6/1959 Hyde et al. ..... 524/714

FOREIGN PATENT DOCUMENTS 1085563 9/1980 Canada .
1549180 7/1979 United Kingdom .

*Primary Examiner*—A. Lionel Clingman
*Attorney, Agent, or Firm*—Jim L. DeCesare

[57] ABSTRACT

A method of enhancing the rewettability of fabrics treated in a laundering operation in which the fabrics are contacted with a mixture including a rinse cycle fabric softening conditioning composition capable of producing on the fabrics a hydrophobic surface, and a hydrophobic cationic emulsion of a silicone polymer. Preferably, the fabric softening conditioning composition includes a cationic compound selected from the group consisting of quaternary ammonium salts and organic based compounds having $C_{12}$ to $C_{18}$ hydrocarbon chain molecules of amines, esters, acids, or amine oxides, and the silicone polymer is a highly branched and crosslinked polydimethylsiloxane.

17 Claims, No Drawings

METHOD OF ENHANCING FABRIC REWETTABILITY WITH AN AQUEOUS EMULSION OF BRANCHED AND CROSS-LINKED POLYDIMETHYLSILOXANE

RELATED APPLICATIONS

This application is a continuation-in-part of our prior copending application U.S. Ser. No. 236,864, filed on Aug. 26, 1988, now abandoned.

BACKGROUND OF THE INVENTION

This invention relates to a fabric softening composition and to methods of treating fabrics in order to enhance their water absorbing capabilities.

A fabric softener is a dilute solution or dispersion of a quaternary ammonium derivative used to treat fabrics in the final rinse of a laundering process in order to make the fabrics feel softer. In addition to softness, fabric softeners are known to also provide fluffiness control. Because of the affinity of quaternary ammonium compounds for negatively charged surfaces, their single largest market has been as fabric softeners. Commercial fabric softeners generally include about a four to eight percent dispersion of quaternary ammonium compound which is added to the rinse cycle of the washing process. The quaternary ammonium compound can also be applied to a nonwoven sheet or a polyurethane foam which is added with wet clothes in a dryer. Such sheets contain a fatty acid ester which allows the quaternary ammonium compound to transfer from the sheet to the clothes in the dryer during the drying cycle. Recently, there have been devised combined detergent and softener formulations which allow introduction of all additives in the wash cycle.

Modern washing machines work automatically and the operator places the laundry in the machine, pours in the detergent, and sets the controls. One set of controls determines whether the machine employs hot, warm, or cold water. Water enters the machine through hoses connected to the hot and cold water pipes. The operator also sets controls in order to select the length of washing and rinsing time, and the amount of water that enters the machine. The machine is powered by an electric motor and includes a filter that removes lint, and automatic dispensers for bleach and fabric softeners. A wash cycle typically includes four stages. In the wash cycle, after water fills the wash tub, an agitator reverses direction alternately and moves the laundry through the water and detergent, and forces water through the items of laundry. The washer is then emptied of all of the wash liquor in the spin cycle and the clothes are spun to remove excess water. In the rinse cycle, clean water is added along with the fabric softener and the clothes are again agitated. The washer is emptied of rinse liquor and the clothes are spun in a final spin cycle during which time excess water is removed and pumped out of the machine through a drain hose. The clothing is then ready to be removed from the machine and dried in a dryer or hung on a clothesline until dry.

Fabric softeners for use in such machines are well known in the art. For example, in British Pat. No. 1,549,180, issued July 25, 1979, Dumbrell et al disclose a fabric softener which includes, in addition to the softening benefit, the additional benefits of easier ironing, antistatic properties, pleasanter feel, and soil release properties. The additional benefits are stated to be derived from the inclusion along with a cationic quaternary ammonium fabric softening agent, of a silicone compound which is said to be an aqueous emulsion of a linear siloxane.

The Dumbrell et al Canadian Pat. No. 1,085,563 is a version of the United Kingdom Patent. The Canadian Patent elaborates as to the meaning of the term "predominately linear" of the United Kingdom Patent, and on page 6, in the last paragraph, the Canadian Patent specifies that a "limited degree of cross linking can be tolerated". The materials of the present invention, however, are "highly" branched and crosslinked materials containing at most less than forty percent of linear silicone polymer and hence are quite distinct from the materials employed in either of the related Dumbrell et al United Kingdom and Canadian Patents. In fact, on Page 10, the Canadian Patent specifies that a crosslinked silicone is outside the scope of the invention.

Specifically, Dumbrell et al relate to fabric softening compositions that include an aqueous dispersion of a cationic softening compound, and a silicone emulsion. The cationic compound is disclosed to be one or more or mixtures of a combination of quaternary monammonium compounds such as tallowtrimethylammonium chloride, and ditetradecyldimethylammonium chloride; quaternary imidazolinium compounds; polyammonium compounds such as acid salts of diamine compounds, and polyamine salts; and polyalkyleneimine salts. The silicone emulsion is preferably a linear dialkyl or alkylaryl siloxane which may be partially or wholly fluorinated, or substituted with cationic nitrogen groups. The viscosity is disclosed to be, at twenty-five degrees Centigrade, at least one hundred and up to eight thousand centistokes. The weight ratio of siloxane content of the emulsion to the dispersion is five to one, to one to one-hundred. Representative compositions are said to be cationic emulsion polymerized dimethylsiloxanes, with the emulsifying agent being, for example, ditallowyldimethylammonium chloride; quaternized polysiloxanes such as dipyridinium polydimethylsiloxane; and aminofunctional linear polysiloxanes such as polydimethylsiloxanes containing dimethylaminopropyl groups.

Silicone polymers can be classified as being linear, branched, or crosslinked. This classification is commonly accepted and is used in the silicone industry. Branched or crosslinked silicone polymers are prepared by the incorporation of an alkyl trisiloxy unit into the siloxane polymer chain. Crosslinking results when two alkyl trisiloxy units are connected by a segment of the polymer chain during the polymerization process. The number of polymer branches which react with another polymer (or a different alkyl trisiloxy unit on the same polymer) to form crosslinks is a function of the amount of alkyl trisiloxy units present, and the reaction conditions. It is generally accepted in the industry that the inclusion of alkyl trisoloxy units will lead to branching and crosslinking when polydiorganosiloxane is prepared via addition polymerization. Because of the random nature of this polymerization, however, alkyl trisiloxy groups will not be incorporated into all of the polymer chains; some linear polymers will normally be present in such systems. Incorporation of a methyl trisiloxy unit into a polydimethylsiloxane results in a branched and crosslinked siloxane and not a linear siloxane. The use of the branched and crosslinked fluids in a rinse cycle fabric softener is not taught in Dumbrell et al since the incorporation of a trisiloxy unit into the linear siloxane polymer chain creates a branched and crosslinked siloxane that has significantly different properties. For example, linear siloxanes are soluble in toluene whereas branched and crosslinked siloxanes are not. Thus, a toluene solubility test provides a simple method to distinguish between linear and nonlinear polydimethylsiloxanes. In addition to differences in solubility, linear and nonlinear polydimethylsiloxanes exhibit different physical properties. Linear polydimethylsiloxanes are liquids which exhibit viscous flow, even at high molecular weights. Branched or crosslinked polydimethylsiloxanes of comparable molecular weight are elastomers. The properties of the silicone polymer in an water-based emulsion is conveniently determined by "breaking" the emulsion by adding large amounts of salt or alcohol, or evaporating the water and examining the residue. Since the two classes of siloxane polymers have such significant differences in physical properties, it would not be obvious to substitute a branched and crosslinked siloxane for a linear siloxane in fabric softener applications.

In accordance with the present invention therefore, a branched and crosslinked silicone emulsion is employed in contrast to the linear material of Dumbrell et al. More importantly, it has been found that the use of an emulsion of nonlinear silicone provides certain advantages neither taught nor appreciated by Dumbrell et al. For example, softener treated fabrics in accordance with the present invention possess enhanced rewettability or improved water absorbency, in addition to softness, and this benefit was neither realized nor contemplated by Dumbrell et al. Thus, while Dumbrell et al observed a series of benefits resulting from the incorporation in the softener formulation of a linear silicone material, the rewettability property of the present invention was not one of the benefits discovered by Dumbrell et al, nor the feature of branching or crosslinking in general. In the present invention, therefore, water absorptivity or rewettability of fabrics treated with hydrophobic softening agents is significantly improved, as is softening by the use of branched and crosslinked silicone fluid emulsions. The use of hydrophobic silicones as taught herein to improve water absorbency of treated fabrics is unexpected since silicones are considered to provide water repellency properties to fabrics rather than enhanced rewettability. Thus, the opposite result would be expected. Accordingly, the present invention provides compositions and methods of fabric treatment possessing significant advantages over prior art materials and processes as exemplified by Dumbrell et al.

SUMMARY OF THE INVENTION

This invention relates to a method of enhancing the rewettability of fabrics treated in a laundering operation by contacting the fabrics with a mixture including a rinse cycle fabric softening conditioning composition capable of producing on the fabrics a hydrophobic surface, and a hydrophobic cationic emulsion of a silicone polymer.

The invention also relates to a method of enhancing the rewettability or water absorbency of fabrics treated in a laundering operation by contacting the fabrics with a hydrophobic cationic emulsion of a silicone polymer, the silicone polymer including highly branched and crosslinked polydimethylsiloxane fluids.

The invention further relates to a fabric softening composition for enhancing the rewettability of fabrics treated in a laundering operation which is a mixture including a rinse cycle conditioning composition capable of producing on the fabrics a hydrophobic surface, and a hydrophobic cationic emulsion of a branched and crosslinked silicone polymer. In preferred embodiments, the rinse cycle conditioning composition includes a cationic compound selected from the group consisting of quaternary ammonium salts and organic based compounds having $C_{12}$ to $C_{18}$ hydrocarbon chain molecules of amines, esters, acids, or amine oxides. As noted above, the branched and crosslinked silicone polymer is a highly branched and crosslinked polydimethylsiloxane, and the branched and crosslinked silicone polymer includes less than about forty percent of linear silicone polymer as determined by extraction with toluene. The cationic compound of the rinse cycle conditioning composition preferably constitutes from about four percent to about eight percent by weight of the rinse cycle conditioning composition, and the mixture contains from about one-half of one percent to about six percent by weight of the silicone polymer emulsion. The emulsion of the silicone polymer contains about thirty-five percent by weight of active ingredient, and the cationic compound of the rinse cycle conditioning composition is dihydrogenated-tallow dimethyl ammonium chloride in a specific embodiment. The emulsion of the silicone polymer is preferably aqueous.

It is therefore the object of the present invention to not only treat fabrics such as towels, for example, in order to make them feel softer and fluffier, but in addition, to enhance the rewettability of the towel so that the towel will be capable of absorbing more water at the conclusion of the treating and drying cycles normally encountered in their routine daily usage.

These and other features, objects, and advantages, of the herein described present invention will become apparent when considered in conjunction with the following detailed description of the present invention.

DETAILED DESCRIPTION OF THE INVENTION

Ammonium compounds in which all of the hydrogen atoms have been substituted by alkyl groups are called quaternary ammonium salts. These compounds may be represented in a general sense by the formula:

$$[R^4-\overset{\overset{R^1}{|}}{\underset{\underset{R^3}{|}}{N}}^{+}-R^2]X^-$$

The nitrogen atom includes four covalently bonded substituents that provide a cationic charge. The R groups can be any organic substituent that provides for a carbon and nitrogen bond with similar and dissimilar R groups. The counterion X is typically halogen. Use of quaternary ammonium compounds is based on the lipophilic portion of the molecule which bears a positive charge. Since most surfaces are negatively charged, solutions of these cationic surface active agents are readily adsorbed to the negatively charged surface.

In accordance with the present invention, the hydrophobic softening agent can include quaternary ammonium salts, and specifically any of the cationic compounds described in British Pat. No. 1,549,180, such as quaternary mono-ammonium compounds having either two $C_{12}$–$C_{20}$ alkyl chains or one $C_{18}$–$C_{24}$ alkyl chain;

quaternary imidazolinium textile softeners; polyammonium compounds; fabric softening polyamine salts; fully substituted polyquaternary compounds; and polyalkylene imine salts. Particular quaternary ammonium compounds suitable for use herein may include, for example, trimethyltallowammonium chloride, trimethylsoyaammonium chloride, trimethylcocoammonium chloride, dimethyldicocoammonium chloride, dimethyldi(hydrogenated tallow)ammonium chloride, trimethyldodecylammonium chloride, trimethyloctadecylammonium chloride, trimethylhexadecylammonium chloride, dimethylalkylbenzylammonium chloride, 1:1 mixture of trimethyltallowammonium chloride and dimethyldicocoammonium chloride, N,N,N',N',N'-pentamethyl-N-tallow-1,3-propanediammonium dichloride, methylbis(2-hydroxyethyl)-cocoammonium chloride, methylpolyoxyethylene cocoammonium chloride, methylbis(2-hydroxyethyl)oleylammonium chloride, methylpolyoxyethylene oleyammonium chloride, methylbis(2-hydroxyethyl)oleylammonium chloride, methylbis(2-hydroxyethyl)octadecylammonium chloride, methylpolyoxyethylene octadecylammonium chloride, n-dodecyl tetradecyl dimethylbenzylammonium chloride, n-tetradecyl hexadecyl dimethylbenzylammonium chloride, n-dodecyl tetradecyl dimethyldichlorobenzylammonium chloride, n-octadecyldimethylbenzylammonium chloride, dialkylmethylbenzylammonium chloride, n-dodecyl tetradecyl hexadecyl dimethylbenzylammonium chloride, n-dodecyl tetradecyl hexadecyl dimethylethylbenzylammonium chloride, methyl sulfate quaternary of ethyoxylated tallow diethylenetriamine condensate, methyl sulfate quaternary of propoxylated tallow diethylenetriamine condensate, and 1-(tallow amidoethylene)-2-nor (tallow alkyl)-2-imidazolinium, methyl sulfate quaternary.

The silicone compositions of the present invention that enhance the rewettability of fabrics treated in a laundry operation are primarily highly branched and crosslinked polydimethylsiloxanes and substituted derivatives, such as organofunctional silicones. The resulting enhanced rewettability is independent of the siloxane molecular weight. If the silicone polymer is substituted with organofunctional groups, the resulting polymer must be hydrophobic to improve rewettability. The hydrophobic silicones are delivered to the fabric as an emulsion. The silicone emulsions can be used alone or formulated into a fabric conditioning composition, such as a rinse cycle fabric softener. The quaternary ammonium salt based type of rinse cycle fabric softeners are preferred.

While the following examples are combinations of quaternary based softeners with silicone emulsions, the silicone compositions will improve water absorbancy when used in combination with any organic based fabric conditioning composition that produces a hydrophobic surface, such as organic conditioning compositions comprised of long hydrocarbon $C_{12}$–$C_{18}$ chain molecules of amines, esters, acids, amine oxides, and derivatives thereof.

The polydimethylsiloxanes used herein are high molecular weight branched and crosslinked polymers having a molecular weight of at least 100,000, and a viscosity above 50,000 centistokes. The viscosity of such a polydimethylsiloxane is highly dependent on the degree of branching and crosslinking present in the polymer. When the ratio of alkyl trisiloxy units to dimethyl siloxy units exceeds about 1:100, the polymer can no longer be considered a fluid with a measurable viscosity; it is an elastomer. The siloxane polymers of the present invention are generally terminated by a hydroxyl group. Endblocking species such as trimethyl siloxy units are not included in the compositions of the present invention because this would prevent the polymer from reaching the desired molecular weight. The polymers can be prepared by various techniques such as the hydrolysis and subsequent condensation of dimethyldihalosilanes, or by the cracking and subsequent condensation of dimethylcyclosiloxanes. The polymer can be based on a branched and crosslinked silicone made by the addition of branching units of methyl trimethoxysilane to polydimethylsiloxane by conventional techniques, in a preferred mode.

EXAMPLE I

Towels were prepared for treatment by removing the mill textile conditioners applied at the mill during manufacture of the towels. The process was conducted at a commerical laundromat. Bundles of 86:14 cotton polyester terry towels were washed three times with a 9.8% phosphorous containing Tide® detergent followed by three washes with a 0.5% phosphorous containing Tide®. Tide® is an anionic detergent and a trademark of the Procter & Gamble Company, Cincinnati, Ohio. The towels were subjected to a final wash and rinse cycle from which detergent was omitted, in order to remove any residual detergent. The treatments were conducted in a Whirlpool Imperial Seventy washing machine. The Cycle Setting was Heavy/14 minutes. The Cloth to Liquor Ratio was 1:23. The Wash Temperature was Warm (32° C.). The Rinse Temperature was Cold (11° C.). The Detergent Concentration was 0.14% detergent by weight of wash liquor. The Dryer was a Whirlpool model with a Dryer Setting of Permanent Press-High Drying, at a time of 55 minutes.

The test used to measure softness was a panel test in which ten people were asked to rank several towels in order of softness, one being a control towel which had not been treated with a softening agent. The towels were treated by the method described above. Following treatment, the towels were placed in a constant temperature and humidity room over night and tested the following day. Ten people were asked to evaluate the towels by feeling the towels and choosing the harshest towel, the softest towel, and placing the remaining towels in order of increasing softness. The towels were assigned a numerical ranking with the highest value corresponding to the softest towel. Since the softness of a towel increases with repeated handling, a new surface of each towel was exposed for each panel member, and each towel was replaced after evaluation by three people. The resulting rankings were averaged to provide a single integer for each treatment.

The rewettability or water absorbency of the treated towels was determined by the wicking method in which strips of fabric are suspended in a solution of water soluble dye and the height of migration of the dye solution is measured over a specified time. The greater height of migration of the dye solution up the fabric is indicative of better rewet properties.

The height to which the dye solution had risen was measured after the strip had been immersed for four minutes, and the variability of the test method was +/−6.9 mm.

Fabric softener formulations containing varying amounts of an emulsion of highly branched and crosslinked silicone polymer were evaluated for softening and rewettability. As noted above, terry towels of 86:14 cotton/polyester were treated with detergent, and softeners were added in the rinse cycle at a softener/fabric weight ratio of 1:30. Each of the formulations employed included five percent dihydrogenated tallow dimethylammonium chloride(DTDMAC), the active ingredient of a quaternary ammonium salt commercial fabric softener dispersion, manufactured by Sherex Chemical Company, Dublin, Ohio, as ADOGEN ® 442, a trademark of that company; together with varying amounts of the composition of the present invention in amounts of one, two, four, and six percent concentrations, respectively. One control of DTDMAC without the composition of the present invention was employed for comparative purposes. The five percent DTDMAC quaternary ammonium salt softener was prepared by melting dihydrogenated tallow dimethylammonium chloride and adding the molten material to hot water under agitation. The softener was stirred until cool. Sodium chloride was included in order to lower the viscosity, and ethanol was added in order to assist in solubilizing the softener. The composition of the present invention included therein was a thirty-five percent aqueous hydrophobic cationic emulsion of a highly branched and crosslinked polydimethylsiloxane fluid including less than about forty percent of linear silicone polymer. A series of five treatments were conducted, and evaluations were made following the first, third, and fifth treatments. Average softness rankings are set forth in Table I.

TABLE I

| COMPOSITION | | TREATMENT | | |
|---|---|---|---|---|
| % Softener* | Silicone % | No. I | No. III | No. V |
| 100 | — | 1.9 | 1.2 | 1.0 |
| 99 | 1.0 | 3.0 | 2.6 | 2.3 |
| 98 | 2.0 | 3.2 | 3.7 | 3.7 |
| 96 | 4.0 | 3.6 | 4.5 | 4.0 |
| 94 | 6.0 | 3.3 | 3.0 | 4.0 |

* = 5% DTDMAC

It should be apparent from Table I that the softener ingredient containing the higher levels of the compositions of the present invention imparted the best softness. The rewettability of each of the foregoing is set forth in Table II, and it should be pointed out, that the average rewettability imparted to each fabric was enhanced by the softeners including the compositions of the present invention.

TABLE II

| COMPOSITION | | REWETTABILITY |
|---|---|---|
| % Softener* | Silicone % | mm/4 minutes |
| 100 | — | 42 |
| 99 | 1.0 | 53 |
| 98 | 2.0 | 55 |
| 96 | 4.0 | 57 |
| 94 | 6.0 | 58 |

* = 5% DTDMAC

EXAMPLE II

Example I was repeated except that the softener DTDMAC was replaced by a commercial grade rinse cycle fabric softening product. The product was an aqueous dispersion of fabric softening agents including about five percent DTDMAC as the active softening agent. The branched and crosslinked composition of the present invention employed in Example I was again used in this example. The results are set forth in Table III.

TABLE III

| COMPOSITION | | TREATMENT | | |
|---|---|---|---|---|
| % Softener* | Silicone % | No. I | No. III | No. V |
| 100 | — | 3.3 | 2.6 | 4.1 |
| 99.5 | 0.5 | 3.9 | 2.4 | 1.8 |
| 99 | 1.0 | 2.3 | 3.5 | 3.6 |
| 98 | 2.0 | 2.9 | 4.7 | 4.8 |
| 96 | 4.0 | 5.1 | 4.7 | 3.0 |

* = Dispersion which contains 5% DTDMAC as the active softening agent.

The rewettability of each of the foregoing is set forth in Table IV, and it should be pointed out, that the average rewettability imparted to each fabric was enhanced by the softeners including the compositions of the present invention.

TABLE IV

| COMPOSITION | | REWETTABILITY |
|---|---|---|
| % Softener* | Silicone % | mm/4 minutes |
| 100 | — | 37 |
| 99.5 | 0.5 | 49 |
| 99 | 1.0 | 47 |
| 98 | 2.0 | 58 |
| 96 | 4.0 | 58 |

* = See Table III.

EXAMPLE III

Example II was repeated again using the commercial grade rinse cycle fabric softening product of Example II which was an aqueous dispersion of fabric softening agents including five percent DTDMAC as the active softening agent. For purposes of comparison, there was employed a series of emulsions of silicone compositions having varying amounts of linear siloxane content. These emulsions were added to the commercial softener at a level of two percent by weight. The silicone emulsions contained mixtures of linear and nonlinear siloxanes with the percentage of linear polymers ranging from about twelve percent to about thirty-five percent indicating a branched and crosslinked siloxane content ranging from about sixty-five percent to as high as eighty-eight percent. The linear polymer content for the emulsions was determined by toluene extraction of dried samples of emulsion. The results are set forth in Tables V and VI.

TABLE V

| COMPOSITION | | | TREATMENT | | |
|---|---|---|---|---|---|
| % Silicone | % Softener* | % Branching/ Crosslinking | No. I | No. III | No. V |
| 2 | 98 | — | 4.0 | 2.9 | 2.5 |
| 2 | 98 | 65 | 3.5 | 3.2 | 3.1 |
| 2 | 98 | 65 | 3.8 | 4.2 | 4.6 |
| 2 | 98 | 88 | 2.7 | 4.2 | 3.9 |
| 2 | 98 | 65 | 5.2 | 3.8 | 3.7 |

* = See Table III.

The rewettability of each of the foregoing is set forth in Table VI, and it should be pointed out, that the average rewettability imparted to each fabric was enhanced by the softeners including the branched and crosslinked compositions of the present invention.

TABLE VI

| COMPOSITION | | | REWETTABILITY mm/4 minutes |
|---|---|---|---|
| % Silicone | % Softener* | % Branching/ Crosslinking | |
| 2 | 98 | — | 43 |
| 2 | 98 | 65 | 56 |
| 2 | 98 | 65 | 58 |
| 2 | 98 | 88 | 59 |
| 2 | 98 | 65 | 51 |

* = See Table III.

The branched and crosslinked silicone polymers employed herein and methods for their preparation are described in more or less detail in U.S. Pat. No. 2,891,920, issued June 23, 1959, the disclosure of which is incorporated herein by reference. These materials can be any organosiloxane of the formula:

$$R_nSiO_{\frac{4-n}{2}}$$

in which R is selected from the group consisting of monovalent hydrocarbon radicals, halogenated monovalent hydrocarbon radicals, and hydrogen atoms; and in which n is an interger having an average value of from one to less than three. However, for purposes of illustration, a procedure for the preparation of a representative branched and crosslinked silicone polymer of the present invention is set forth in the following examples.

EXAMPLE IV 88 grams of a 27% water solution of tallow trimethyl ammonium chloride was added to 535 grams of water until a uniform mixture was obtained. To this mixture was added 350 grams of octamethylcyclotetrasiloxane and 6.5 grams of methyl trimethoxysilane followed by vigorous stirring. The resulting emulsion was passed twice through a homogenizer set at 7500 psig. The emulsion was then made alkaline by the addition of 1 gram of a 50% sodium hydroxide solution. The emulsion was heated at 85 degrees Centigrade for 9 hours. After cooling to 40 degrees Centigrade, 1.5 grams of 85% phosphoric acid was added and stirred for 5 minutes followed by the addition of MAKON® 10, a nonyl phenoxy-polyethylene oxide surfactant. The emulsion was allowed to stir for 1 hour at 40 degrees Centigrade. Upon cooling to room temperature 0.5 grams of KATHON® CG/ICP, a preservative, was added.

Whereas Example IV is specific to methyl trimethoxysilane, branching may also be obtained with materials such as $$(CH_3O)_3Si(CH_2)_3NHCH_2CH_2NH_2$$

and $$(CH_3O)_3Si(CH_2)_3N^{\oplus}(CH_3)_2(CH_2)_{17}CH_3Cl^{\ominus}.$$

Compositions prepared in accordance with Example IV, when tested in accordance with the procedures of Example II, yielded the following rewettability data.

TABLE VII

| TREATMENTS | REWETTABILITY mm/4 minutes |
|---|---|
| 1 | 62 |
| 2 | 42 |

TABLE VII-continued

| TREATMENTS | REWETTABILITY mm/4 minutes |
|---|---|
| 3 | 56 |
| 4 | 58 |
| 5 | 58 |
| 6 | 62 |

Additional compositions prepared as in Example IV were further tested in accordance with the procedure of Example II except that instead of employing the aqueous dispersion of softening agents including 5% DTDMAC, there was used two commercial rinse cycle fabric softening products marketed for home use. Both products are manufactured by Lever Brothers Company, New York, N.Y., and sold under the trademarks SNUGGLE® and FINAL TOUCH®. Data from these tests are set forth hereinbelow.

TABLE VIII

| COMPOSITION | | TREATMENT | |
|---|---|---|---|
| % Softener* | Silicone % | No. I | No. III |
| 100 | — | 4.5 | 4.0 |
| 99.5 | 0.5 | 3.8 | 4.8 |
| 99 | 1.0 | 3.1 | 2.7 |
| 98 | 2.0 | 4.6 | 4.5 |
| 96 | 4.0 | 3.8 | 4.0 |

* = FINAL TOUCH ®

TABLE IX

| COMPOSITION | | TREATMENT | |
|---|---|---|---|
| % Softener* | Silicone % | No. I | No. III |
| 100 | — | 4.1 | 3.75 |
| 99.5 | 0.5 | 3.2 | 3.75 |
| 99 | 1.0 | 5.3 | 4.17 |
| 98 | 2.0 | 2.8 | 3.5 |
| 96 | 4.0 | 4.6 | 4.83 |

* = SNUGGLE ®

TABLE X

| COMPOSITION | | REWETTABILITY mm/4 Minutes TREATMENT | |
|---|---|---|---|
| % Softener* | Silicone % | No. I | No. III |
| 100 | — | 48 | 37 |
| 99.5 | 0.5 | 48.5 | 51 |
| 99 | 1.0 | 50 | 54 |
| 98 | 2.0 | 48 | 55 |
| 96 | 4.0 | 51 | 54.5 |

* = FINAL TOUCH ®

TABLE XI

| COMPOSITION | | REWETTABILITY mm/4 Minutes TREATMENT | |
|---|---|---|---|
| % Softener* | Silicone % | No. I | No. III |
| 100 | — | 31 | 31.5 |
| 99.5 | 0.5 | 40 | 44 |
| 99 | 1.0 | 47.5 | 51.5 |
| 98 | 2.0 | 48 | 51.5 |
| 96 | 4.0 | 50 | 52 |

* = SNUGGLE ®

A procedure for the preparation of another representative branched and crosslinked silicone polymer of the present invention is set forth in the following examples.

EXAMPLE V 88 grams of a 27% water solution of tallow trimethyl ammonium chloride was added to 535 grams of water until a uniform mixture was obtained. To this mixture was added 350 grams of octamethylcyclotetrasiloxane and 7.5 grams of methyl trimethoxysilane followed by vigorous stirring. The resulting emulsion was passed twice through a homogenizer set at 7500 psig. The emulsion was then made alkaline by the addition of 1 gram of a 50% sodium hydroxide solution. The emulsion was heated at 85 degrees Centigrade for 9 hours. After cooling to 40 degrees Centigrade, 1.5 grams of 85% phosphoric acid was added and stirred for 5 minutes followed by the addition of MAKON® 10, a nonyl phenoxy-polyethylene oxide surfactant. The emulsion was allowed to stir for 1 hour at 40 degrees Centigrade. Upon cooling to room temperature 0.5 grams of KATHON® CG/ICP, a preservative, was added.

Compositions prepared in accordance with Example V, were tested in accordance with the procedures of Example II, except that SNUGGLE® was again employed, and such tests yielded the following data.

TABLE XII

| COMPOSITION | | TREATMENT | |
|---|---|---|---|
| % Softener* | Silicone % | No. I | No. III |
| 100 | — | 3.55 | 3.0 |
| 98 | 2.0 | 3.82 | 3.8 |

* = SNUGGLE ®

TABLE XIII

| COMPOSITION | | REWETTABILITY mm/4 Minutes TREATMENT | |
|---|---|---|---|
| % Softener* | Silicone % | No. I | No. III |
| 100 | — | 35 | 40.5 |
| 98 | 2.0 | 53 | 51 |

* = SNUGGLE ®

A further procedure for the preparation of an additional representative branched and crosslinked silicone polymer of the present invention is set forth in the following examples.

EXAMPLE VI 88 grams of a 27% water solution of tallow trimethyl ammonium chloride was added to 535 grams of water until a uniform mixture was obtained. To this mixture was added 350 grams of octamethylcyclotetrasiloxane and 35.0 grams of methyl trimethoxysilane followed by vigorous stirring. The resulting emulsion was passed twice through a homogenizer set at 7500 psig. The emulsion was then made alkaline by the addition of 1 gram of a 50% sodium hydroxide solution. The emulsion was heated at 85 degrees Centigrade for 9 hours. After cooling to 40 degrees Centigrade, 1.5 grams of 85% phosphoric acid was added and stirred for 5 minutes followed by the addition of MAKON® 10, a nonyl phenoxy-polyethylene oxide surfactant. The emulsion was allowed to stir for 1 hour at 40 degrees Centigrade. Upon cooling to room temperature 0.5 grams of KATHON® CG/ICP, a preservative, was added.

Compositions prepared in accordance with Example VI, were tested in accordance with the procedures of Example II, again using SNUGGLE®, and yielded the following data.

TABLE XIV

| COMPOSITION | | TREATMENT | |
|---|---|---|---|
| % Softener* | Silicone % | No. I | No. III |
| 100 | — | 3.55 | 3.0 |
| 98 | 2.0 | 3.55 | 3.4 |

* = SNUGGLE ®

TABLE XV

| COMPOSITION | | REWETTABILITY mm/4 Minutes TREATMENT | |
|---|---|---|---|
| % Softener* | Silicone % | No. I | No. III |
| 100 | — | 35 | 40.5 |
| 98 | 2.0 | 48 | 54 |

* = SNUGGLE ®

Generically, the branched and crosslinked siloxanes set forth in the foregoing examples are of the general formula:

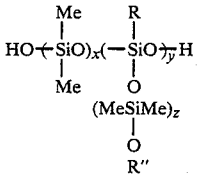

wherein:

Me is methyl;

x and z have values of 3 to 100,000;

y has a value of 1 to 10,000;

R is $(CH_2)_nZ$;

R″ is hydrogen or

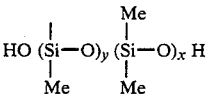

n has a value of 1 to 10;

Z is

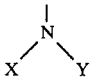

whereby X and Y are selected independently, —H; —$C_{1-30}$-alkyl; —$C_6$-aryl; —$C_{5-6}$-cycloalkyl; —$C_{1-6}$—$NH_2$; —CO—R′; with the proviso that the nitrogen can be quaternized such as to represent

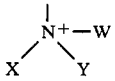

whereby W can be selected from X or Y; or Z is

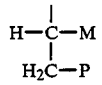

whereby P and M are —COOH; —CO—$NR'_2$; or $C_{1-2}$-alkyl; where $R' = C_{1-4}$ alkyl.

It will be apparent from the foregoing that many other variations and modifications may be made in the structures, compounds, compositions, and methods described herein without departing substantially from the essential features and concepts of the present invention. Accordingly, it should be clearly understood that the forms of the invention described herein are exemplary only and are not intended as limitations on the scope of the present invention.

That which is claimed is:

1. The method of enhancing the rewettability of fabrics treated in a laundering operation comprising contacting the fabrics with a mixture including a rinse cycle fabric softening conditioning composition capable of producing a hydrophobic surface on the fabrics selected from the group consisting of quaternary ammonium salts and organic compounds having $C_{12}$ to $C_{18}$ hydrocarbon chain molecules of amines, esters, acids or amine oxides and an aqueous emulsion of a highly branched and crosslinked silicone polymer, the polymer being an organosiloxane of the formula:

$$R_nSiO_{\frac{4-n}{2}}$$

in which R is selected from the group consisting of monovalent hydrocarbon radicals, halogenated monovalent hydrocarbon radicals, and hydrogen atoms; and in which n is an interger having a value one or two, the branched and crosslinked silicone polymer being a mixture including less than about forty percent of linear silicone polymer as determined by extraction with toluene.

2. The method of claim 1 wherein the branched and crosslinked silicone polymer is essentially polydimethylsiloxane.

3. The method of claim 2 wherein the cationic compound of the rinse cycle fabric softening conditioning composition constitutes from about four percent to about eight percent by weight of the composition.

4. The method of claim 3 wherein the mixture contains from about one-half of one percent to about six percent by weight of the branched and crosslinked silicone polymer emulsion.

5. The method of claim 4 wherein the emulsion of the branched and crosslinked silicone polymer contains about thirty-five percent by weight of polymer.

6. The method of claim 5 wherein the cationic compound of the rinse cycle fabric softening conditioning composition is dihydrogenated-tallow dimethyl ammonium chloride.

7. The method of enhancing the rewettability of fabrics treated in a laundering operation comprising contacting the fabrics with an aqueous emulsion of a highly branched and crosslinked silicone polymer, the polymer being an organosiloxane of the formula:

$$R_nSiO_{\frac{4-n}{2}}$$

in which R is selected from the group consisting of monovalent hydrocarbon radicals, halogenated monovalent hydrocarbon radicals, and hydrogen atoms; and in which n is an interger having an value of one or two, the branched and crosslinked silicone polymer being essentially a polydimethylsiloxane, the branched and crosslinked silicone polymer being a mixture including less than about forty percent of linear silicone polymer as determined by extraction with toluene.

8. The method of claim 7 wherein the emulsion of the branched and crosslinked silicone polymer contains about thirty-five percent by weight of polymer.

9. A fabric softening composition having rewet properties for enhancing the rewettability of fabrics treated in a laundering operation comprising a mixture including a rinse cycle conditioning composition capable of producing on the fabrics a hydrophobic surface selected from the group consisting of quaternary ammonium salts and organic compounds having $C_{12}$ to $C_{18}$ hydrocarbon chain molecules of amines, esters, acids or amine oxides, and an aqueous emulsion of a highly branched and crosslinked silicone polymer, the polymer being an organosiloxane of the formula:

$$R_nSiO_{\frac{4-n}{2}}$$

in which R is selected from the group consisting of monovalent hydrocarbon radicals, halogenated monovalent hydrocarbon radicals, and hydrogen atoms, and in which n is an interger having an value of one or two the branched and crosslinked silicone polymer being a mixture including less than about forty percent of linear silicone polymer as determined by extraction with toluene.

10. The composition of claim 9 wherein the branched and crosslinked silicone polymer is essentially polydimethylsiloxane.

11. The composition of claim 10 wherein the cationic compound of the rinse cycle conditioning composition constitutes from about four percent to about eight percent by weight of the rinse cycle conditioning composition.

12. The composition of claim 11 wherein the mixture contains from about one-half of one percent to about six percent by weight of the branched and crosslinked silicone polymer emulsion.

13. The composition of claim 12 wherein the emulsion of the branched and crosslinked silicone polymer contains about thirty-five percent by weight of polymer.

14. The composition of claim 13 wherein the cationic compound of the rinse cycle conditioning composition is dihydrogenated-tallow dimethyl ammonium chloride.

15. The method of enhancing the rewettability of fabrics treated in a laundering operation comprising contacting the fabrics with a mixture including a rinse cycle fabric softening conditioning composition capable of producing on the fabrics a hydrophobic surface selected from the group consisting of quaternary ammonium salts and organic compounds having $C_{12}$ to $C_{18}$ hydrocarbon chain molecules of amines, esters, acids or amine oxides, and an aqueous emulsion of a silicone polymer having the general formula:

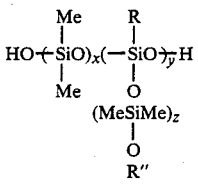

wherein:

Me is methyl;

x and z have values of 3 to 100,000;

y has a value of 1 to 10,000;

R is $(CH_2)_nZ$;

R'' is hydrogen or

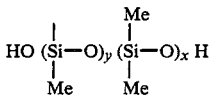

n has a value of 1 to 10;

Z is

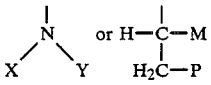

and X and Y are selected independently from —H; —$C_{1-30}$-alkyl; —$C_6$-aryl; —$C_{5-6}$-cycloalkyl; —$C_{1-6}$—$NH_2$; —CO—R'; with the proviso that the nitrogen can be quaternized such as to represent

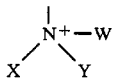

whereby W can be selected from X or Y; whereby P and M are —COOH; —CO—NR'$_2$; or $C_{1-2}$-alkyl; where R'=$C_{1-4}$ alkyl.

16. The method of enhancing the rewettability of fabrics treated in a laundering operation comprising contacting the fabrics with an aqueous emulsion of a silicone polymer, the silicone polymer being a polydimethylsiloxane having the general formula:

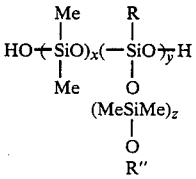

wherein:

Me is methyl;

x and z have values of 3 to 100,000;

y has a value of 1 to 10,000;

R is $(CH_2)_nZ$;

R'' is hydrogen or

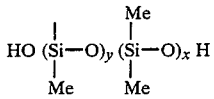

n has a value of 1 to 10;

Z is

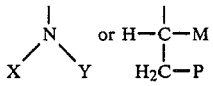

and X and Y are selected independently, —H; —$C_{1-30}$-alkyl; —$C_6$-aryl; —$C_{5-6}$-cycloalkyl; —$C_{1-6}$—$NH_2$; —CO—R'; with the proviso that the nitrogen can be quaternized such as to represent

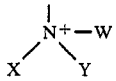

whereby W can be selected from X or Y; whereby P and M are —COOH; —CO—NR'$_2$; or $C_{1-2}$-alkyl; where R'=$C_{1-4}$ alkyl.

17. A fabric softening composition having rewet properties for enhancing the rewettability of fabrics treated in a laundering operation comprising a mixture including a rinse cycle conditioning composition capable of producing on the fabrics a hydrophobic surface selected from the group consisting of quaternary ammonium salt and organic compounds having $C_{12}$ to $C_{18}$ hydrocarbon chain molecules of amines, esters, acids or amine oxides, and a an aqueous emulsion of a silicone polymer having the general formula:

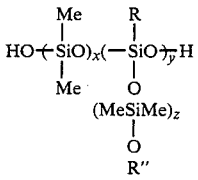

wherein:

Me is methyl;

x and z have values of 3 to 100,000;

y has a value of 1 to 10,000;

R is $(CH_2)_nZ$;

R'' is hydrogen or

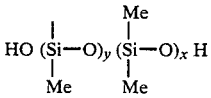

n has a value of 1 to 10;

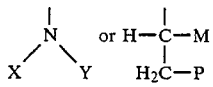

and X and Y are selected independently from —H; —$C_{1-30}$-alkyl; —$C_6$—aryl; —$C_{5-6}$-cycloalkyl; —C-

$_{1-6}$—$NH_2$; —CO—R′; with the proviso that the nitrogen can be quaternized such as to represent
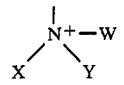
whereby W can be selected from X or Y; whereby P and M are —COOH; —CO—$NR'_2$; or $C_{1-2}$-alkyl; where $R' = C_{1-4}$ alkyl.
* * * * *